United States Patent [19]

Cappelli

[11] Patent Number: 5,074,082

[45] Date of Patent: Dec. 24, 1991

[54] METHOD FOR PRODUCING BIFOCAL CONTACT LENSES

[76] Inventor: Quido A. Cappelli, 241 Hollywood Ave., Crestwood, N.Y. 10707

[21] Appl. No.: 456,302

[22] Filed: Dec. 26, 1989

[51] Int. Cl.[5] ..... B24B 13/00

[52] U.S. Cl. ..... 51/284 R; 51/326; 51/327

[58] Field of Search ..... 51/284 R, 326, 327, 51/109 R, 124 L, 101 LG, 105 LG, 106 LG, 165.75, 283 R

[56] References Cited

U.S. PATENT DOCUMENTS

| | | | |
|---|---|---|---|
| 4,199,231 | 4/1980 | Evans | 351/161 |
| 4,202,848 | 5/1980 | Neefe | 51/284 R |
| 4,239,712 | 12/1980 | Neefe | 51/284 R |
| 4,322,517 | 3/1982 | Deubzer et al. | 351/160 H |
| 4,618,229 | 10/1986 | Jacobstein et al. | 351/161 |
| 4,854,089 | 8/1989 | Morales | 51/284 R |

*Primary Examiner*—James G. Smith
*Assistant Examiner*—Blynn Shideler
*Attorney, Agent, or Firm*—Seymour G. Bekelnitzky

[57] ABSTRACT

A method for producing a bifocal contact lens comprising, in combination, the steps of generating a first, concave surface on a first side of a lens blank eccentrically mounted in concave surface cutting means, wherein the center of curvature of the concave surface lies on an axis offset from the optical center axis of the lens blank by a prism offset distance; generating a second, convex surface on the second side of the lens blank, wherein the center of curvature of the convex surface lies on the optical center axis of the lens blank; generating a third, convex surface on the second side of the lens blank eccentrically mounted in convex surface cutting means, wherein the center of curvature of the third, convex surface is coaxial with the second, convex surface; trimming the first, concave surface to form a fourth, concave surface on the first side of the lens blank the curvature of the fourth surface corresponding to the base curve; and finishing the lens by known methods. If desired, the posterior optical zone may be decentered by eccentrically mounting the lens blank in edge curve cutting means prior to cutting the edge curves.

17 Claims, 4 Drawing Sheets

METHOD FOR PRODUCING BIFOCAL CONTACT LENSES

This invention relates to a method for producing bifocal contact lenses having improved optical properties. More particularly, it relates to a method for consistently producing bifocal contact lenses having sharply defined refracting areas of differing powers.

Bifocal contact lenses of various compositions are well known. They include lenses fabricated from hard materials, such as gas permeable and non-permeable polymers. Cellulose esters and poly(methyl methacrylate), respectively, are illustrative of such materials. Bifocal contact lenses may also be fabricated from hydrophilic xerogels comprising water insoluble hydrophilic polymers and copolymers such as polymers and copolymers of hydroxyalkyl acrylates and methacrylates and N-vinyl-2-pyrrolidone. The lenses may also be prepared from materials comprising properties of both of the above classes such as the silicone-methacrylate copolymers.

However, marketing of such lenses has not met with great success. That is due, in part, to the difficulty of consistently producing lenses having desired optical properties by conventional methods.

Thus, in lenses prepared in accordance with the prior art techniques, the line of demarcation between the distance and reading, or near vision areas was usually poorly defined, I.e., the separation between the refracting areas was, generally, "fuzzy". The characteristics of the resulting lenses were objectionable to the user.

Cooper, et al, in U.S. Pat. No. 3,300,909, disclosed a method for overcoming the above objection and obtaining lenses with clearly defined lines of demarcation, between the retracting areas, which comprises the "novel" steps of covering the unfinished lens with a covering, or "masking", composition during several of the lens production steps.

Thus, after cutting a concave surface, at a first side of a lens blank, by conventional methods, a first, convex vision area is cut into the second side of the lens blank and polished. That vision area is then coated with the covering composition and the second, convex vision area cut, into the second side of the lens blank and polished. The covering composition is removed from the lens which is then finished in accordance with the prescribed parameters.

The lenses prepared in accordance with Cooper et al's teachings were claimed to have clearly defined lines of demarcation between the two vision areas and, consequently, improved optical properties.

However, the above process suffers from lack of control of segment shape, height, prism and optical quality.

It has now been found that the process of this invention produces bifocal contact lenses having consistent and good properties.

SUMMARY OF THE INVENTION

It is an object of the invention to provide a method for producing bifocal contact lenses having improved physical and optical properties.

It is another object of the invention to provide a method for producing bifocal contact lenses having clearly defined lies of demarcation between the far and near vision areas thereof.

Other objects will be in part apparent and in part specifically disclosed in connection with the following detailed description and accompanying drawing wherein like numerals indicate like parts.

DETAILED DESCRIPTION OF THE PREFERRED EMBODIMENT

Figure 1A:
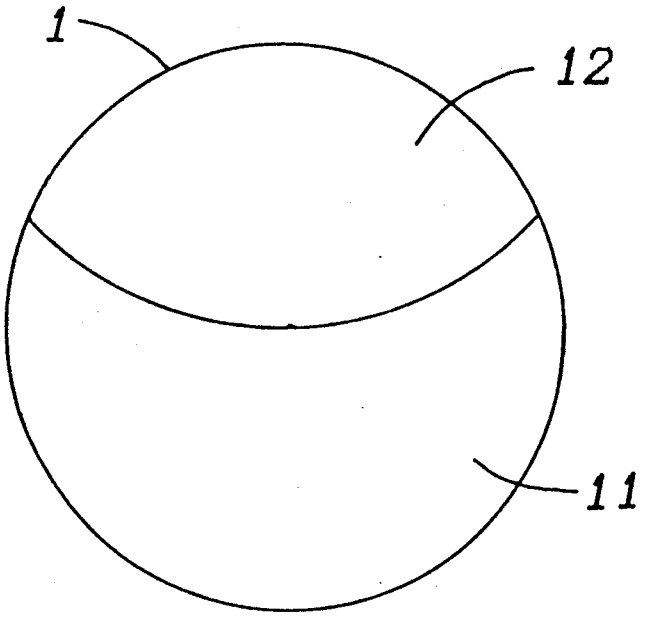
FIG. 1*a* is a top view of a bifocal contact lens prepared according to the method of the invention prior to addition of the edge curves.
Figure 1B:
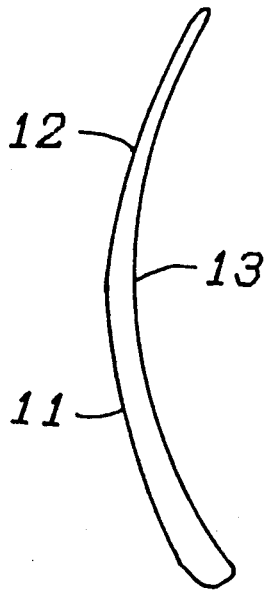
FIG. 1*b* is a sectional side view of the lens of FIG. 1*a*.
Figure 12:
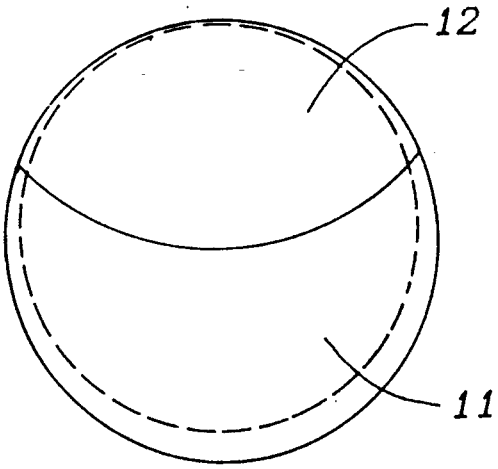
FIG. 12 is a top view of a bifocal contact lens prepared according to the invention.

The method of the instant invention, for producing bifocal contact lenses of improved optical and physical characteristics is best described,, while referring to the drawings, wherein like numbers refer to like parts. FIGS. 1*a* and 1*b*, illustrate the top and side views, respectively, of a bifocal contact lens, represented by the numeral "1", absent edge finishing curves, prepared in accordance with the instant invention. FIG. 12 illustrates the above lens comprising finished edges and ready for use by a patient.

The lens comprises an upper surface comprising two spherical convex curves: curve 11 to provide near and curve 12 to provide far vision corrections. The lens further comprises a spherical concave base curve 13 on its lower surface.

The curves are so positioned that the parallel axes upon which the centers of curvature of curves 11 and 13 lie are separated by a distance which is a function of the radii of curvature of the surfaces and is proportional to the relative amount of ballast prism desired.

Figure 2:
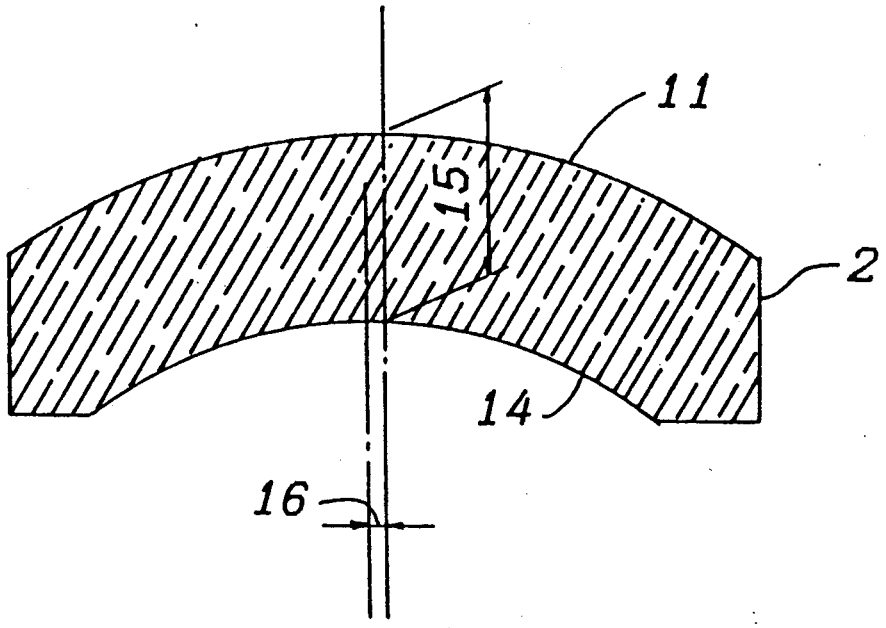
FIG. 2 is a sectional side view of a first lens blank prepared according to the invention.

In accordance with the method of the invention, a first lens blank, illustated in FIG. 2 and represented by numeral "2", is formed by eccentrically generating a concave auxiliary surface 14 in the first side and a second, convex curve 11 in the opposite, second side of a precursor blank. The precursor blank is preferably used in the form of a right cylindrical button. The purpose of the auxiliary surface, which is not polished, is to provide a basis for the prismatic alignment and accurate location of the base curve of the finished lens. The center of curvature of the auxiliary surface 14 is located on an axis separated from the optical axis of curve 11 by the prism offset distance 16.

The radius of curvature of curve 14 is equal to the desired radius of curvature of curve 11 less the thickness 15 of the lens blank 2.

The auxiliary surface 14, having the above-indicated radius of curvature, is generated by eccentrically mounting a right cylindrical button, of any material known to the art, so that its axis of rotation is offset by the prism offset distance 16 from the geometrical center of the button.

A convex curve 11 is then generated by conventional means in the opposite surface, the axis of rotation of the blank now passing through the geometric center thereof. The convex curve is polished in accordance with the practice in the art.

The resulting surfaces of the lens blank will be nearly concentric, allowing for the prism offset distance 16, whereby rotation of the lens blank about the curvature of either surface will maintain the other surface in its proper relative position.

This is required, in order that curve 13, as shown in FIG. 1*b*, may be added as final step, in a departure from prior art procedures, for accurate maintenance of prism orientation. In this manner, the generation of the two refracting surfaces, 11 and 12, is easily accomplished without the complications which arise, in the prior art procedures, from prism orientation.

Figure 4:
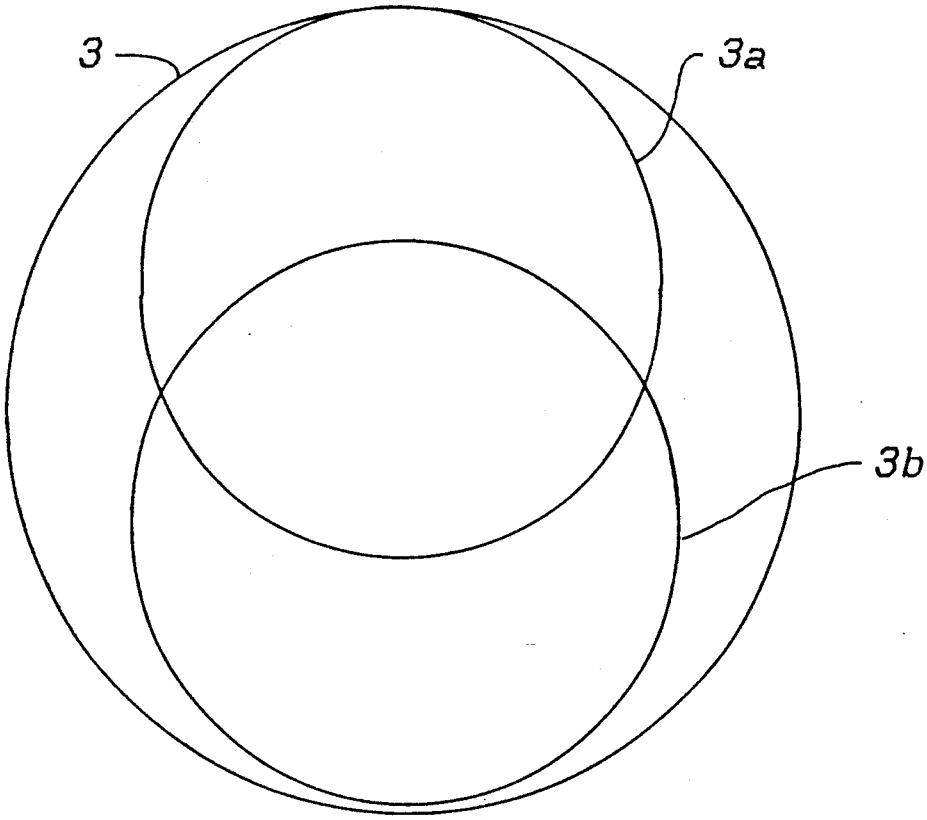
FIG. 4 is a top view of the first lens blank used in the process of the invention showing the position of the final lens diameter.
Figure 3:
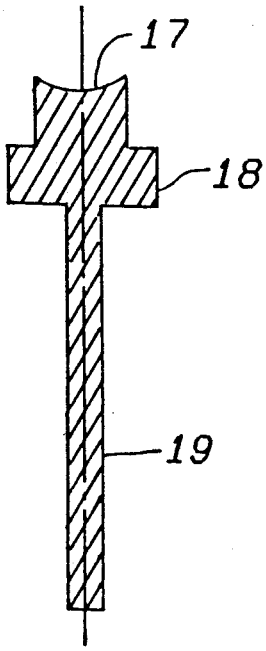

A first spindle arbor 19, as shown in FIG. 3, is prepared to receive the first lens blank, shown in FIG. 4, comprising a working circle 3*a* whose diameter is a function of the final lens size, prism offset distance 16, contact lens blank diameter contract lens shape and other factors known to the art. The diameter of the final lens is also shown in FIG. 4.

The spindle arbor 19 is terminated at one end by a first side of a first lens carrier 18 press-fit to the spindle arbor. The lens carrier is trimmed to a diameter approximately equal to that of the working circle 3*a*. The opposite side of the lens carrier 18 comprises a plastic composition comprising a concave surface 17, whose radius of curvature is approximately equal to, or more steep (+0.00/−0.03 mm) than the radius of curvature at the surface 11.

The spindle arbors, referred to throughout the specification, may be fabricated from any materials known to the art. They are preferably prepared from steel and most preferably from hardened steels.

The lens carriers may also be constructed from any materials known to the art. The most preferred compositions for construction of the lens carriers are brasses.

The curved mounting surfaces on the lens carriers are comprise rigid plastic materials adherent to the lens carrier surface. A preferred material for the curved mounting surfaces is poly(methyl methacrylate).

Figure 5:
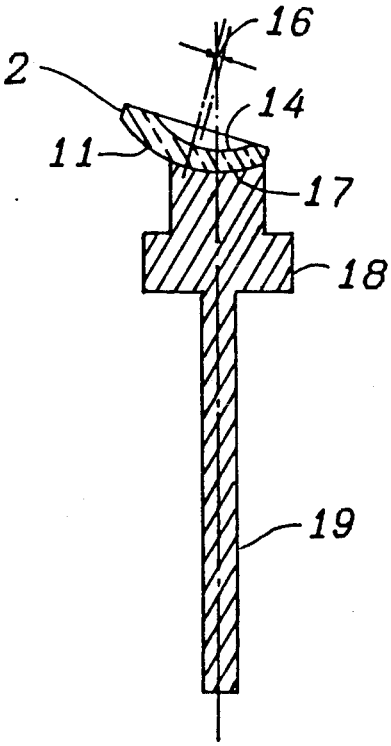
FIG. 5 is a sectional view of the first spindle arbor as used in the process of the invention.

As shown in FIG. 5 the first lens blank 2 is transferred to, and mounted on, the curved surface 17 of lens carrier 18, with the edge of the lens blank aligned with the diameter of the carrier 18 along the axis of the prism offset 16 of the lens blank.

Figure 6:
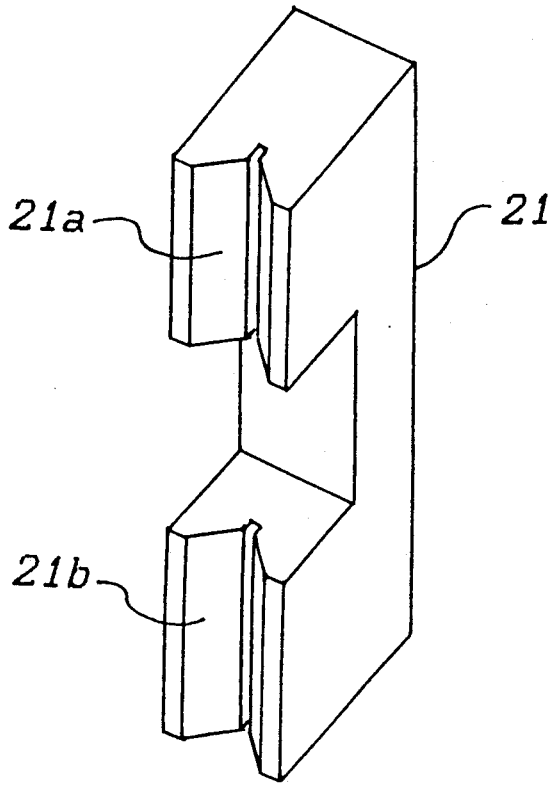
FIG. 6 is a perspective view of a vee-block for use in the process of the invention.

The spindle arbor 19 is then mounted in the lower portion 21*b* of a conventional vee-block mounting fixture indicated by the numeral 21 in FIG. 6. The vee-block mounting fixture must be accurately machined in order that the axes of the separate vee-sections 21*a* and 21*b* be accurately aligned. For purposes of the instant invention, accurate alignment of the vee-section axes is critical.

Figure 7:
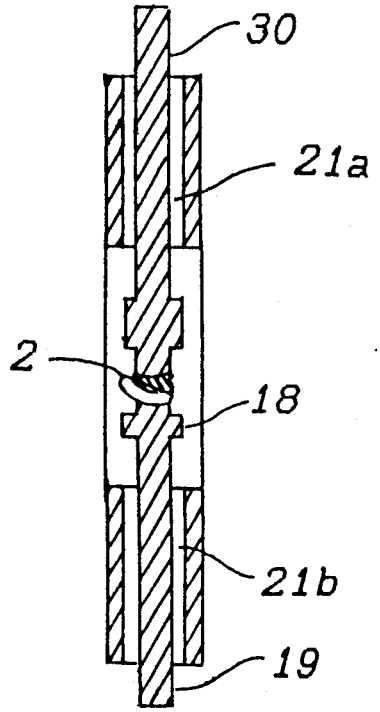
FIG. 7 is a front view of the vee-block of FIG. 6 as used in the process of the invention.

By means of the vee-block mounting fixture 21, the first lens blank 2 is transfer pitch-blocked, as shown in FIG. 7, to a second spindle arbor 30 whose diameter matches that of the first spindle arbor 19.

Figure 8:
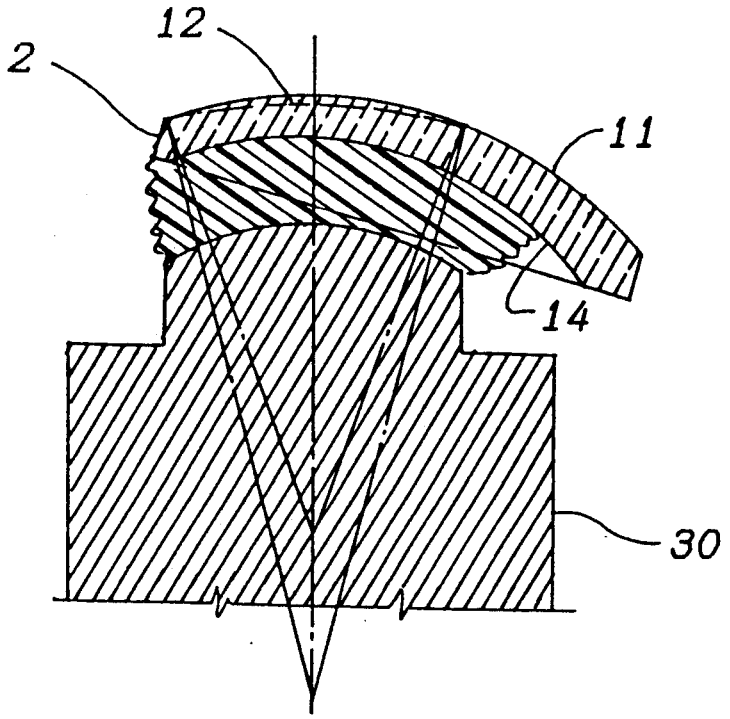
FIG. 8 is a sectional view of the first lens blank mounted on a second spindle arbor for generation of a second lens blank according to the process of the invention.

As shown in FIG. 8, the surface 11 of the first lens blank 2 will be eccentrically mounted but optically centered on the axis of the second spindle arbor 30.

Figure 9:
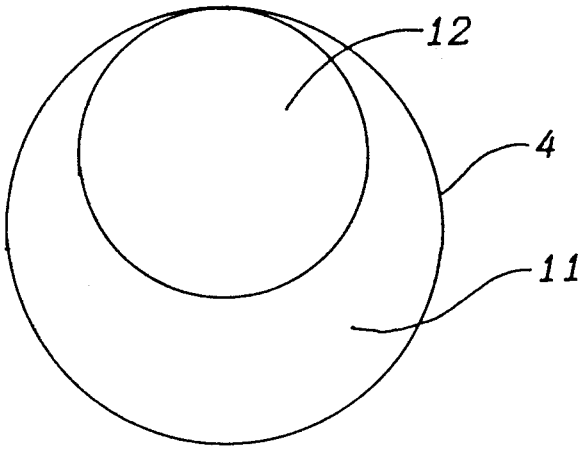
FIG. 9 is a top view of the second lens blank prepared according to the process of the invention.

Spindle arbor 30 is then mounted in a conventional lens cutting lathe and a second, convex curve 12 generated in the upper surface of the first lens blank 2 and polished by known techniques to yield a second lens blank 4 shown in FIG. 9. Its radius of curvature is measured and corrections required to meet lens specification made.

The curve 12 of the second lens blank 4, will have a diameter equal to that of the working circle 3*a* of the first lens blank 2, as shown in FIG. 4, if the depth of the cut (i.e., the amount of material removed) is carefully monitored during the generation of the curve 12.

Ater polishing and verification that the lens meets the specifications, the second lens blank 4 is deblocked from the spindle arbor 30 and the thickness measured at the point taken to be the geometric center of the final lens. That point will be established by the practitioner, who will decide if the junction of surfaces 11 and 12 is to be above or below the lower margin of the pupil of the eye to be fitted. The practitioner will determine that point using a set of trial lenses, in accordance with industry standards.

In order to effectively utilize the auxiliary surface 14 for further mounting purposes, the center thickness of the second lens blank 4 should be within +0.02 mm of the original calculated thickness.

Figure 10:
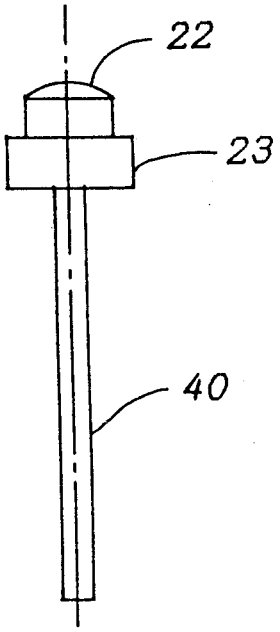
FIG. 10 is a sectional view of the a third spindle arbor for use in the process of the invention.

The second lens blank 4 comprising the curves 11 and 12 is then transferred to a third spindle arbor 40, as illustrated in FIG. 10, upon which a third lens carrier 23 is mounted. The diameter of spindle arbor 40 matches that of spindle arbors 19 and 30. A convex curve 22 is generated on the surface of the third lens carrier 23, having a radius of curvature equal to or slightly flatter (i.e., about −0.00 to about +0.03 mm.) than that of the auxiliary surface 14.

Figure 11:
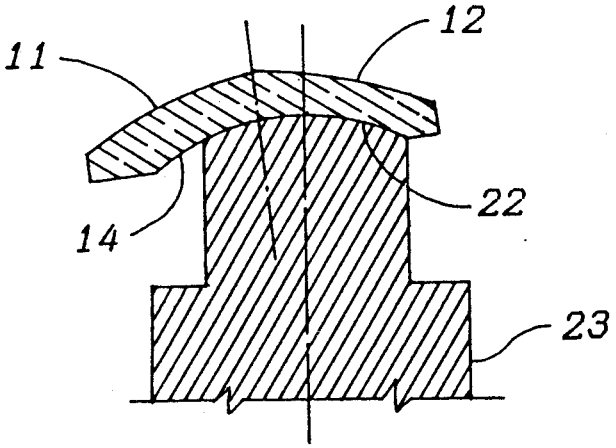
FIG. 11 is a sectional view of the second lens blank mounted on a portion of the spindle arbor of FIG. 10.

The geometic center of the convex curve 22 of carrier blank 23 is suitably marked and the auxiliary surface 14 of lens blank 4 placed against the convex surface 22 of carrier 23, and aligned so that the geometric center of the final lens is in correct spatial relationship with the center of the carrier blank 23, as shown in FIG. 11.

The spindle arbor 40 is then mounted in the vee-block mounting fixture 21 and the second lens blank 4 pitch-blocked to a new spindle arbor, comprising a lens carrier comprising a concave surface to which the second lens blank 4 is eccentrically mounted, to allow the final, concave base curve to be generated and the blank trimmed to the required final lens diameter. The thickness of the lens is controlled by conventional methods.

The base curve is polished and its radius measured. Corrections are then made to conform the lens to the required specifications. After deblocking, the optics of the resulting birefracting surfaces are measured.

In order to minimize the effect of the changing pupil size, which results from various lighting conditions, and to provide a firm foundation for the fitting of these lenses, the normal finishing methods wherein the posterior optical zone of the lens is centered in relation to the diameter is modified so that the posterior optical zone is decentered to the superior portion of the lens, as shown in FIG. 12. In doing so, the width of the secondary curve, which would normally prohibit the propagation of the marginal light rays is eliminated. The resulting configuration will aid stabilization of the positioning of the lens and allow for a greater area for visual purposes, thereby accommodating changing pupil sizes.

Decentration of the posterior optical zone is accomplished by calculating the finite distance that the base curve should be decentered and using the aforementioned vee-block arrangement, whereby the lens may be blocked in a slightly eccentrical position, so that the peripheral curves of the lens may be mechanically generated in the required positions.

The invention having been described in connection with certain specific embodiments thereof it is to be understood that the description is not meant as a limitation since further modifications may suggest themselves to one skilled in the art and it is intended to cover such modifications as fall within the scope of the appended claims.

What is claimed is:

1. A method of producing a plastic bifocal contact lens blank, for use in the preparation of plastic bifocal contact lenses, having a concave base curve on its posterior side, a second, convex and a third, convex surface on its anterior side and a circumferential edge from a button having first, posterior and second, anterior surfaces, a circumferential edge wall, a geometric center at the intersection of horizontal and vertical axes parallel to the planes of the anterior and posterior surfaces, said method consisting of, in combination, the steps of:

a. generating a first, concave surface on the first side of said button to form a lens blank wherein the center of curvature of said lens blank surface lies on an axis of rotation offset from the geometrical center axis of said lens blank by a prism offset distance;

b. generating a second, convex surface on the second side of said lens blank wherein the center of curvature of said convex surface lies on an axis through the geometrical center axis of the lens blank;

c. forming a third, convex surface in said lens blank second side wherein the center of curvature of the third, convex curve lies on the axis of rotation which passes through the center of curvature of the second, convex surface; and d. trimming the first, concave surface to form a fourth, concave surface on the posterior side of said button the curvature of said fourth surface corresponding to the base curve.

2. The method of claim 1 wherein a. the button is eccentrically mounted in a concave surface cutting means with its center of rotation offset from the geometrical center of said button and said first, concave surface is generated in its posterior surface;

b. the button comprising said first, concave surface is then mounted in convex surface cutting means, wherein the center of rotation of the cutting means and the geometrical center of the button are coaxial, and the second, convex surface generated in its anterior surface;

c. generating a third, convex surface on the second side of said button wherein the center of curvature of said third surface lies on the axis of rotation which passes through the center of curvature of the second, convex surface; and d. eccentrically mounting the lens blank of step c. on a third lens carrier, of a third spindle arbor, comprising a convex surface, mounting the third spindle arbor and lens blank in a vee-block fixture, pitch-block transferring said lens blank to a fourth lens carrier on a fourth spindle arbor axially aligned with the third spindle arbor on the vee-block fixture and generating the base curve.

3. The method of claim 1 wherein the lens blank of step (b) is:

a. eccentrically mounted on a first lens carrier at one end of a spindle arbor said carrier comprising at the end opposite the spindle arbor a concave curved surface approximately matching the convex surface of the lens blank;

b. the spindle arbor is then mounted in a vee-block mounting fixture;

c. the lens blank is eccentrically pitch block-transferred from said first lens carrier to a second lens carrier mounted, in said vee-block mounting fixture, coaxially with said first lens carrier the first convex surface being optically centered with the spindle axis; and d. the third, convex surface generated.

4. The method of claim 3 wherein the radius of curvature of the concave surface of the first lens carrier is from about 0.00 to about 0.03 mm less than that of the first convex surface.

5. The method of claim 1 wherein the lens blank of step (c), thereof, is eccentrically mounted on a third lens carrier, having a convex surface the geometric centers of the first, concave surface of the lens blank and convex surface of the third lens carrier being aligned as required to place the geometric centers of the final lens and blank in proper relationship.

6. The method of claim 5, wherein the radius of curvature of the convex surface of the third lens carrier is from 0.00 to about 0.03 mm greater than the radius of curvature of the first, concave surface.

7. The method of claim 5 wherein the lens blank of step (c), of claim 1, is eccentrically mounted on the concave surface of a third lens carrier, the lens carrier and lens blank are mounted in a vee-block mounting fixture, the lens blank is pitch block-transferred to the fourth lens carrier mounted in said vee-block mounting fixture coaxially with the third lens carrier, the lens blank and fourth lens carrier are mounted in concave surface cutting means and the base curve generated.

8. The method of claim 1 wherein the posterior optical zone of the finished lens is decentered by eccentrically mounting the lens blank in edge cutting means, through use of a vee-block fixture, and generating the peripheral curves of the final lens.

9. The method of claim 1 for producing a plastic bifocal contact lens blank, for use in the preparation of plastic bifocal contact lenses, having a concave base curve on its posterior side, a second, convex and a third, convex surface on its anterior side and a circumferential edge from a button having first, posterior and second, anterior surfaces, a circumferential edge wall, a geometric center at the intersection of horizontal and vertical axes parallel to the planes of the anterior and posterior surfaces, said method consisting of, in combination, the steps of:

a. eccentrically mounting a lens blank in a concave surface cutting means with its center of rotation offset from the optical center of said lens blank and generating a first, concave surface on a first side of a lens blank, wherein the center of curvature of said first surface lies on an axis offset from the optical center axis of said lens blank by a prism offset distance;

b. mounting the lens blank of step a. in convex surface cutting means, wherein the center of rotation of the cutting means and the optical center of the lens blank are coaxial and generating a second, convex surface on the second side of said lens blank, wherein the center of curvature of said convex surface lies on the optical center axis of the lens blank;

c. eccentrically mounting the lens blank of step b. on a first lens carrier at one end of a spindle arbor said carrier comprising at the end opposite the spindle arbor a concave curved surface approximately matching the convex surface of the lens blank, mounting said spindle arbor in a vee-block fixture, eccentrically pitch-block transferring the lens blank from said first lens carrier to a second lens carrier mounted in the vee-block fixture and accurately aligned axially with the first lens carrier, mounted in said vee-block fixture, wherein the first, convex surface of the lens blank is optically centered with the second spindle axis and generating a third, convex surface in the second side of said lens blank, wherein the center of curvature of said third, convex surface lies on the axis of rotation which passes through the center of curvature of the second, convex curve;

d. eccentrically mounting the lens blank of step c. on a third lens carrier, of a third spindle arbor, comprising a convex surface, mounting the third spindle arbor and lens blank in a vee-block fixture, pitch-block transferring said lens blank to a fourth lens carrier on a fourth spindle arbor axially aligned with the third spindle arbor on the vee-block fixture and generating the base curve.

10. The method of claim 1 wherein lens blank is composed of rigid materials.

11. The method of claim 10 wherein said rigid materials comprise at least one polymer selected from the group consisting of polymers and copolymers of methyl methacrylate, cellulose esters.

12. The method of claim 11 wherein said copolymers of methyl methacrylate are selected from the group consisting of silicone-methyl methacrylate copolymers and copolymers of methyl methacrylate with fluorinated monomers.

13. The method of claim 1 wherein the lens blank is composed of a hydrophilic xerogel comprising at least one water insoluble hydrophilic polymer.

14. The method of claim 13 wherein said hydrophilic water insoluble polymer is selected from the group consisting of polymers and copolymers of hydroxylalkyl methacrylates and acrylates, N-vinyl lactams, acrylamides and the like.

15. The method of claim 14 wherein said hydrophilic water insoluble polymer is selected from the group consisting of polymers and copolymers of hydroxyethyl and hydroxypropyl methacrylates and acrylates.

16. The method of claim 14 wherein said hydrophilic water insoluble polymer is selected from the group consisting of polymers and copolymers of N-vinyl-2-pyrrolidone.

17. The method of claim 14 wherein said water insoluble hydrophilic polymer is selected from the group consisting of polymers and copolymers of acrylamide.

* * * * *